US007087153B1

(12) United States Patent
Kalnes

(10) Patent No.: US 7,087,153 B1
(45) Date of Patent: Aug. 8, 2006

(54) COMBINATION HYDROCRACKING PROCESS FOR THE PRODUCTION OF ULTRA LOW SULFUR DIESEL

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 550 days.

(21) Appl. No.: 10/358,430

(22) Filed: Feb. 4, 2003

(51) Int. Cl.
*C10G 45/02* (2006.01)
*C10G 45/06* (2006.01)
*C10G 47/30* (2006.01)
*C10G 65/12* (2006.01)

(52) U.S. Cl. ..... 208/59; 208/61; 208/78; 208/103; 208/105; 208/143; 208/208

(58) Field of Classification Search ..... 208/59, 208/61, 78, 103, 105, 143, 208
See application file for complete search history.

(56) References Cited

U.S. PATENT DOCUMENTS 4,428,823 A 1/1984 Hessler et al. ..... 208/78
4,798,665 A 1/1989 Humbach et al. ..... 208/61
5,120,426 A * 6/1992 Johnston et al. ..... 208/100
5,980,729 A * 11/1999 Kalnes et al. ..... 208/89
6,096,191 A 8/2000 Kalnes ..... 208/105
6,190,535 B1 * 2/2001 Kalnes et al. ..... 208/89

* cited by examiner

*Primary Examiner*—Walter D. Griffin
*Assistant Examiner*—Prem C. Singh
(74) *Attorney, Agent, or Firm*—John G. Tolomei; James C. Paschall; John G. Cutts, Jr.

(57) ABSTRACT

A catalytic hydrocracking process for the production of ultra low sulfur diesel wherein a hydrocarbonaceous feedstock is hydrocracked at elevated temperature and pressure to obtain conversion to diesel boiling range hydrocarbons. The resulting hydrocracking zone effluent is hydrogen stripped in a stripping zone maintained at essentially the same pressure as the hydrocracking zone to produce a first gaseous hydrocarbonaceous stream and a first liquid hydrocarbonaceous stream. The first gaseous hydrocarbonaceous stream containing diesel boiling range hydrocarbons is introduced into a desulfurization zone and subsequently partially condensed to produce a hydrogen-rich gaseous stream and a second liquid hydrocarbonaceous stream containing diesel boiling range hydrocarbons. At least a portion of the first liquid stream is thermal cracked to produce diesel boiling range hydrocarbons. An ultra low sulfur diesel product stream is recovered.

15 Claims, 1 Drawing Sheet

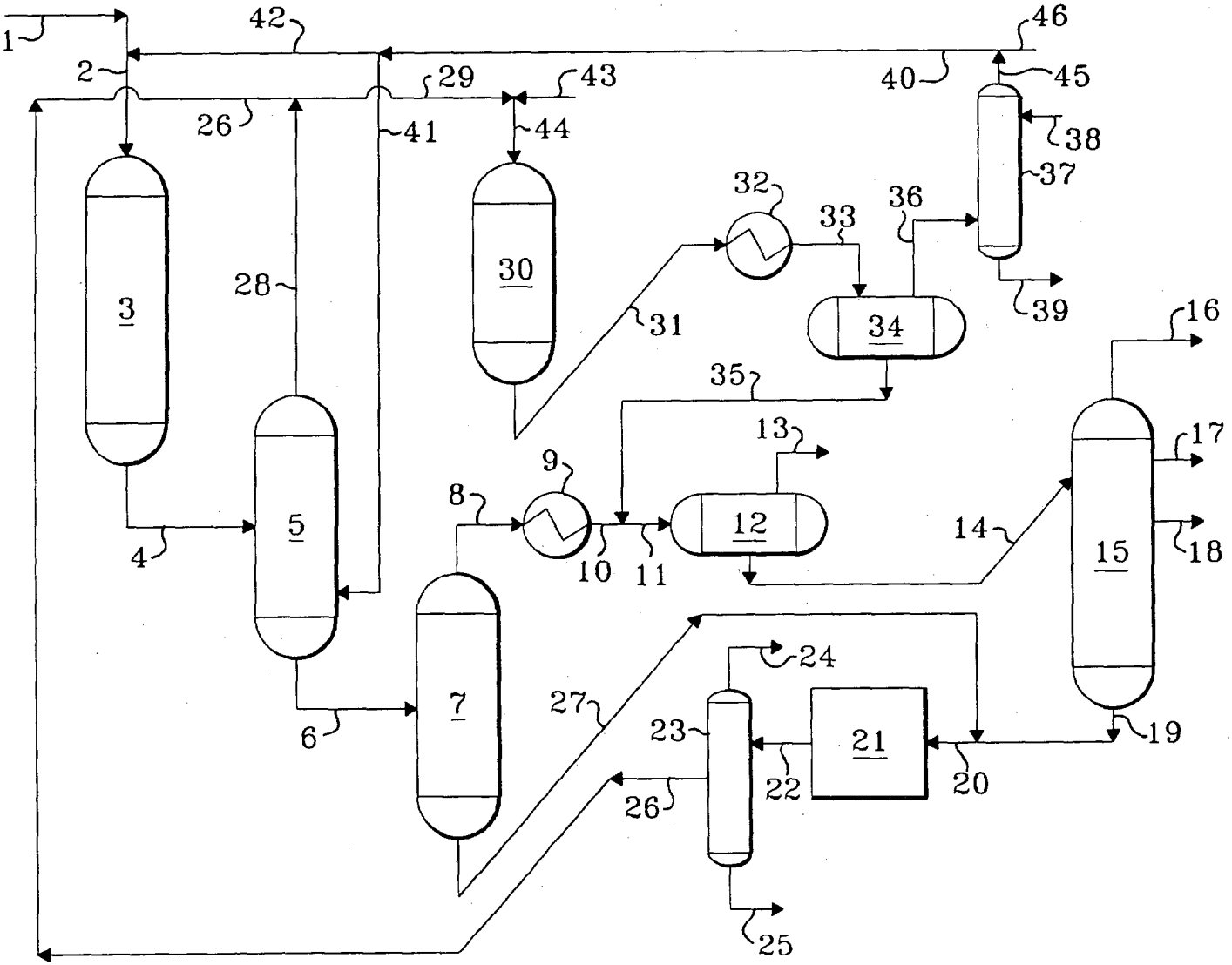
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46

COMBINATION HYDROCRACKING PROCESS FOR THE PRODUCTION OF ULTRA LOW SULFUR DIESEL

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

One of the preferred hydrocarbonaceous products from a hydrocracking process is diesel or diesel boiling range hydrocarbons. Marketable products must meet minimum specifications and over the years, it has been recognized that due to environmental concerns and newly enacted rules and regulations, saleable products including diesel fuel must meet lower and lower limits on contaminants such as sulfur and nitrogen. Recently new regulations were proposed in the United States and Europe which basically require the complete removal of sulfur from liquid hydrocarbons which are used as transportation fuels such as gasoline and diesel.

Although a wide variety of process flow schemes, operating conditions and catalysts have been used in commercial hydrocracking activities, there is always a demand for new hydrocracking methods which provide lower costs and improved product characteristics. The present invention is able to economically hydrocrack a hydrocarbonaceous feedstock while simultaneously producing ultra low sulfur diesel product.

INFORMATION DISCLOSURE

U.S. Pat. No. 6,096,191 B1 discloses a catalytic hydrocracking process wherein a hydrocarbonaceous feedstock and a liquid recycle stream are contacted with hydrogen and a hydrocracking catalyst to obtain conversion to lower boiling hydrocarbons. The resulting effluent from the hydrocracking zone is hydrogen stripped at essentially the same pressure as the hydrocracking zone and at least a portion is recycled to the hydrocracking reaction zone.

U.S. Pat. No. 4,428,823 discloses an integrated hydrocarbon conversion process wherein two different heavy oil feed streams are thermally processed. A vacuum gas oil is charged to a thermal cracking zone and a reduced crude fraction is charged to a visbreaking heater. The effluent of each thermal operation is separated into vapor and liquid fractions with the vapor fractions being fed to a product fractionator. The liquid fractions each enter separate but interconnected sub-atmospheric pressure separation zones, one of which is a vacuum column. The bottoms of a product fractionator and distillate from the vacuum column are also charged to the thermal cracking zone.

U.S. Pat. No. 4,798,665 discloses a process for the conversion of a gas oil to selectively produce large quantities of middle distillate which comprises reacting the gas oil in a hydrocracking zone to convert at least a portion of the charge stock to lower boiling hydrocarbon products including middle distillate; separating the resulting hydrocracking zone effluent to provide a middle distillate product stream and a paraffin-rich hydrocarbonaceous stream boiling at a temperature greater than about 371° C. (700° F.); reacting the paraffin-rich hydrocarbonaceous stream in a non-catalytic thermal reaction zone to provide a non-catalytic thermal reaction zone effluent; and recovering a middle distillate product stream.

BRIEF SUMMARY OF THE INVENTION

The present invention is a combination hydrocarbon conversion process which utilizes a catalytic hydrocracking zone and a thermal cracking zone to produce ultra low sulfur diesel with high conversion by utilizing an integrated flow scheme to minimize the capital costs of major equipment as well as utility costs.

One embodiment of the present invention relates to a hydrocracking process for the production of ultra low sulfur diesel from a hydrocarbonaceous feedstock wherein the process comprises the steps of: (a) reacting the hydrocarbonaceous feedstock and hydrogen in a hydrocracking zone containing hydrocracking catalyst to produce diesel boiling range hydrocarbons; (b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream; (c) passing the first gaseous hydrocarbonaceous stream comprising diesel boiling range hydrocarbons to a desulfurization zone containing desulfurization catalyst and producing a desulfurization zone effluent stream; (d) condensing at least a portion of the desulfurization zone effluent stream to produce a second hydrogen-rich gaseous stream and a second liquid hydrocarbonaceous stream comprising diesel boiling range hydrocarbons; (e) passing the first liquid hydrocarbonaceous stream to a hot flash zone maintained at a pressure from about 445 kPa (50 psig) to about 2858 kPa (400 psig) and a temperature from about 232° C. (450° F.) to about 468° C. (875° F.) to produce a third liquid hydrocarbonaceous stream comprising unconverted hydrocarbons and diesel boiling range hydrocarbons; (f) reacting the third liquid hydrocarbonaceous stream in a non-catalytic thermal cracking zone to produce an effluent stream containing additional diesel boiling range hydrocarbons; (g) separating the effluent stream produced in step (f) to produce a fourth liquid hydrocarbonaceous stream comprising diesel boiling range hydrocarbons; and (h) recovering an ultra low sulfur diesel product stream.

Another embodiment of the present invention relates to a hydrocracking process for the production of ultra low sulfur diesel from a first hydrocarbonaceous feedstock and a second hydrocarbonaceous feedstock boiling in a range lower than that of the first hydrocarbonaceous feedstock which process comprises the steps of: (a) reacting the first hydrocarbonaceous feedstock and hydrogen in a hydrocracking zone containing hydrocracking catalyst to produce diesel boiling range hydrocarbons; (b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream; (c) passing the first gaseous hydrocarbonaceous stream comprising diesel boiling range hydrocarbons and the second hydrocarbonaceous feedstock to a desulfurization zone containing desulfurization catalyst and producing a desulfurization zone effluent stream; (d) condensing at least a portion of the desulfurization zone effluent stream to produce a second hydrogen-rich gaseous stream and a second liquid hydrocarbonaceous stream comprising diesel boiling range hydrocarbons; (e) passing the first liquid hydrocarbonaceous stream to a hot flash zone maintained at a pressure from about 445 kPa (50 psig) to about 2858 kPa (400 psig) and a temperature from about 232° C. (450° F.) to about 468° C. (875° F.) to produce a third liquid hydrocarbonaceous stream comprising unconverted hydrocarbons and diesel boiling range hydrocarbons; (f) reacting the third liquid hydrocarbonaceous stream in a non-catalytic thermal cracking zone to produce an effluent stream containing additional diesel boiling range hydrocarbons; (g) separating the effluent stream produced in step (f) to produce a fourth liquid hydrocarbonaceous stream comprising diesel boiling range hydrocarbons; and (h) recovering an ultra low sulfur diesel product stream.

Yet another embodiment of the present invention relates to a hydrocracking process for the production of ultra low sulfur diesel from a first hydrocarbonaceous feedstock and a second hydrocarbonaceous feedstock boiling in a range lower than that of the first hydrocarbonaceous feedstock which process comprises the steps of: (a) reacting the first hydrocarbonaceous feedstock and hydrogen in a hydrocracking zone containing hydrocracking catalyst to produce diesel boiling range hydrocarbons boiling in the range from about 154° C. (309° F.) to about 370° C. (680° F.); (b) stripping a hydrocracking zone effluent in a hot, high pressure stripping zone maintained at essentially the same pressure as the hydrocracking zone and a temperature in the range of from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream; (c) passing the first gaseous hydrocarbonaceous stream comprising diesel boiling range hydrocarbons and the second hydrocarbonaceous feedstock to a desulfurization zone containing desulfurization catalyst and producing a desulfurization zone effluent stream; (d) condensing at least a portion of the desulfurization zone effluent stream to produce a second hydrogen-rich gaseous stream and a second liquid hydrocarbonaceous stream comprising diesel boiling range hydrocarbons; (e) passing the first liquid hydrocarbonaceous stream to a hot flash zone maintained at a pressure from about 445 kPa (50 psig) to about 2858 kPa (400 psig) and a temperature from about 232° C. (450° F.) to about 468° C. (875° F.) to produce a third liquid hydrocarbonaceous stream comprising unconverted hydrocarbons and diesel boiling range hydrocarbons; (f) reacting the third liquid hydrocarbonaceous stream in a non-catalytic thermal cracking zone to produce an effluent stream containing additional diesel boiling range hydrocarbons; (g) separating the effluent stream produced in step (f) to produce a fourth liquid hydrocarbonaceous stream comprising diesel boiling range hydrocarbons; (h) passing at least a portion of the fourth liquid hydrocarbonaceous stream to the desulfurization zone containing desulfurization catalyst; and (i) recovering an ultra low sulfur diesel product stream.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a recovery of ultra low sulfur diesel and a lower cost of production can be achieved in the above-described integrated hydrocracking process unit.

The process of the present invention is particularly useful for low cost hydrocracking of a hydrocarbon oil containing hydrocarbons and/or other organic materials to produce a product containing hydrocarbons and/or other organic materials of lower average boiling point and lower average molecular weight. More particularly, the present invention is readily able to produce ultra low sulfur diesel. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above (288° C.) 550° F., such as atmospheric gas oils, vacuum gas oils, deasphalted oils, vacuum, and atmospheric residua, hydrotreated residual oils, coker distillates, straight run distillates, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product. One of the most preferred gas oil feedstocks will contain hydrocarbon components which boil above 288° C. (550° F.) with best results being achieved with feeds containing at least 25 percent by volume of the components boiling between 315° C. (600° F.) and 538° C. (1000° F.).

In a preferred embodiment, a second hydrocarbonaceous feedstock having a boiling range lower than the boiling range of the primary feedstock is introduced into the desulfurization zone of the present invention.

The selected feedstock is introduced into a hydrocracking zone. The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about (232° C.) (450° F.) to about 468° C. (875° F.), a pressure from about 3548 kPa (500 psig) to about 20785 kPa (3000 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 normal $m^3/m^3$ (25,000 standard cubic feet per barrel). In accordance with the present invention, the term "substantial conversion to lower boiling products" is meant to connote the conversion of at least 10 volume percent of the fresh feedstock. Total conversion of the feedstock to lower boiling products is preferably less than 80 volume percent, more preferably less than 60 volume percent and even more preferably less than 50 volume percent.

In one embodiment, after the hydrocarbonaceous feedstock has been subjected to hydrocracking as hereinabove described, the resulting effluent from the hydrocracking reaction zone is introduced into a stripping zone maintained at essentially the same pressure as the hydrocracking zone and a temperature from about 232° C. (450° F.) to about 468° C. (875° F.), and counter-currently contacted with a hydrogen-rich gaseous stream to produce a first gaseous hydrocarbonaceous stream containing hydrocarbonaceous compounds comprising diesel boiling range hydrocarbons and a first liquid hydrocarbonaceous stream preferably containing hydrocarbonaceous compounds boiling at a temperature greater than about 371° C. (700° F.). By maintaining the pressure of the stripping zone at essentially the same pressure as the reaction zone is meant that any difference in pressure is due to the pressure drop required to flow the effluent stream from the reaction zone to the stripping zone. It is preferred that the pressure drop is less than about 445 kPa (50 psig).

The resulting first gaseous hydrocarbonaceous stream containing diesel boiling range hydrocarbons is introduced into a desulfurization zone containing desulfurization catalyst. Preferred desulfurization conditions include a temperature from about 204° C. (400° F.) to about 482° C. (900° F.) and a liquid hourly space velocity from about 0.1 to about 10 $hr^{-1}$. It is contemplated that the desulfurization zone may also perform other hydroprocessing reactions such as aromatic saturation, nitrogen removal, cetane improvement and color improvement, for example.

Suitable desulfurization catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical desulfurization temperatures range from about 204° C. (400° F.) to about 482° C. (900° F.) with pressures from about 2.2 MPa (300 psig) to about 17.3 MPa (2500 psig), preferably from about 2.2 MPa (300 psig) to about 13.9 MPa (2000 psig).

In a preferred embodiment, a second hydrocarbonaceous feedstock boiling in a range lower than that of the first hydrocarbonaceous feedstock is introduced into the desulfurization zone containing desulfurization catalyst. The second hydrocarbonaceous feedstock preferably boils at a temperature from about 180° C. (356° F.) to about 370° C. (698° F.) and may be selected from the group consisting essentially of visbroken distillate, light cycle oil, straight run kerosene, straight run diesel, coker distillate and tar sand derived distillate.

The resulting effluent from the desulfurization zone is partially condensed and introduced into a vapor-liquid separator operated at a temperature from about 21° C. (70° F.) to about 60° C. (140° F.) to produce a hydrogen-rich gaseous stream containing hydrogen sulfide and a second liquid hydrocarbonaceous stream. The resulting hydrogen-rich gaseous steam is preferably passed through an acid gas scrubbing zone to reduce the concentration of hydrogen sulfide to produce a purified hydrogen-rich gaseous stream, a portion of which may then be recycled to the hydrocracking zone and the hot, high pressure stripper.

The second liquid hydrocarbonaceous stream is preferably introduced into a cold flash drum to remove dissolved hydrogen and normally gaseous hydrocarbons. The cold flash drum is preferably operated at a temperature from about 21° C. (70° F.) to about 60° C. (140° F.) and a pressure from about 789 kPa (100 psig) to about 2858 kPa (400 psig). The resulting flashed liquid from the cold flash drum is introduced into a fractionation zone to preferably produce LPG, naphtha, kerosene and low sulfur diesel product streams. The bottoms stream form the fractionation zone contains unconverted feedstock having a reduced concentration of sulfur and is introduced into a non-catalytic thermal cracking zone to produce additional diesel boiling range hydrocarbons.

The non-catalytic thermal cracking zone is preferably operated at conditions including a heating coil outlet temperature between about 426° C. (800° F.) and 523° C. (975° F.), and a pressure from about 445 kPa (50 psig) to about 4930 kPa (700 psig). It is common practice in thermal cracking units to recycle a portion of the available gas oil fractions such that the recycle to feed ratio may be from about 1.1:1 to about 5:1. This allows the achievement of the desired total amount of conversion with a lower percentage of cracking per pass and hence milder operating conditions. The recycling also allows the dilution of olefinic products and reduces polymerization and coking within the heating coils. Further details of the thermal cracking zone are readily available in U.S. Pat. Nos. 3,549,519 and 4,201,659.

The first liquid hydrocarbonaceous steam is preferably introduced into a hot flash drum to vaporize and remove dissolved hydrogen and lower boiling hydrocarbonaceous compounds. The resulting liquid from the hot flash drum is then also introduced into the non-catalytic thermal cracking zone as described above to produce additional diesel boiling range hydrocarbons.

The resulting effluent from the non-catalytic thermal cracking zone is preferably introduced into a fractionation zone to produce a stream containing normally gaseous hydrocarbons, a stream containing diesel boiling range hydrocarbons and a bottoms stream containing unconverted feedstock having a reduced concentration of sulfur. At least a portion of the stream containing diesel boiling range hydrocarbons from the thermal cracking zone is preferably introduced into the desulfurization zone.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and light cycle oil is introduced into the process via line 1 and is admixed with a hydrogen-rich gaseous stream provided via line 42 and the resulting admixture is introduced via line 2 into hydrocracking zone 3. A resulting hydrocracking zone effluent is transported via line 4 and introduced into hot, high pressure stripper 5 to produce an overhead hydrocarbonaceous vapor stream carried via line 28 and admixed with a hereinafter described hydrocarbonaceous stream provided via line 26 and the resulting admixture is carried via lines 29 and 44 and introduced into hydrodesulfurization zone 30. A resulting hydrodesulfurization zone effluent stream is carried via line 31 and is cooled and partially condensed in heat exchanger 32 and the resulting cooled stream is carried via line 33 and introduced into high pressure separator 34. A hydrogen-rich gaseous stream is removed from high pressure separator 34 via line 36 and introduced into acid gas recovery zone 37. A lean solvent is introduced via line 38 into acid gas recovery zone 37 and contacts the hydrogen-rich gaseous stream in order to dissolve an acid gas. A rich solvent containing acid gas is removed from acid gas recovery zone 37 via line 39 and recovered. A hydrogen-rich gaseous stream containing a reduced concentration of acid gas is removed from acid gas recovery zone 37 via line 45 and is admixed with a hydrogen makeup stream provided via line 46 and the resulting admixture is transported via line 40. The hydrogen-rich gaseous stream carried via line 40 is bifurcated and a first portion is carried via line 42 and is introduced into hydrocracking zone 3 via line 2 as hereinabove described and a second stream is carried via line 41 and is introduced as stripping gas into hot, high pressure stripper 5. A liquid hydrocarbonaceous stream is removed from hot, high pressure stripper 5 via line 6 and is introduced into hot flash drum 7 to produce a vaporous stream, carried via line 8, which is cooled by heat exchanger 9 and the resulting cooled stream is carried via line 10 and is admixed with a hereinafter described hydrocarbonaceous liquid stream provided via line 35 and the resulting admixture is carried via line 11 and introduced into cold flash drum 12. A normally gaseous hydrocarbonaceous stream is removed from cold flash drum 12 via line 13 and recovered. A liquid stream is removed from cold flash drum 12 via line 14 and introduced into fractionation zone 15. A normally gaseous hydrocarbonaceous stream is removed from fractionation zone 15 via line 16 and recovered. A naphtha hydrocarbonaceous stream is removed from fractionation zone 15 via line 17 and recovered. A distillate hydrocarbon stream containing low sulfur diesel boiling range hydrocarbons is removed via line 18 from fractionation zone 15 and recovered. A liquid hydrocarbonaceous stream is removed from hot flash drum 7 via line 27 and is admixed with a heavy hydrocarbonaceous bottom stream from fractionation zone 15 carried via line 19 and the resulting mixture is introduced via line 20 into non-catalytic thermal cracking zone 21. An effluent from non-catalytic thermal cracking zone 21 is carried via line 22 and introduced into fractionation zone 23. A gaseous hydrocarbonaceous stream is removed from fractionation zone 23 via line 24 and recovered. A heavy hydrocarbonaceous liquid stream is removed from fractionation zone 23 via line 25 and recovered. A diesel boiling range hydrocarbon stream is removed from fractionation zone 23 via line 26 and is introduced into hydrodesulfurization zone 30 via lines 26, 29 and 44 as hereinabove described. A second feed is introduced via line 43 and carried via line 44 and is introduced into hydrodesulfurization zone 30.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A hydrocracker feedstock having the characteristics presented in Table 1 is charged at a rate of 100 mass units per hour to a hydrocracking reaction zone containing a middle distillate selective hydrocracking catalyst.

TABLE 1

| Feedstock Properties | |
|---|---|
| Boiling Range | 315° C. (600° F.)–538° C. (1000° F.) |
| Specific Gravity | 0.93 |
| Sulfur, weight percent | 1.82 |
| Nitrogen, wppm | 741 |
| Carbon Residue, weight percent | 0.39 |

The hydrocracking reaction is performed with an average catalyst temperature of 390° C. (735° F.), a pressure of 9.06 MPa (1300 psig), a liquid hourly space velocity of 1.04 $hr^{-1}$ and a hydrogen circulation rate of 506 $nm^3/m^3$ (3000 SCFB). The resulting effluent from the hydrocracking zone is introduced into a hot, high pressure separator operated at about 9.06 MPa (1300 psig) and stripped with a hydrogen-rich gaseous stream in an amount of about 169 $nm^3/m^3$ (1000 SCFB) based on the fresh feed to the hydrocracking reaction zone. An overhead gaseous hydrocarbonaceous stream containing diesel boiling range hydrocarbons in an amount of 34.4 mass units per hour and a co-feedstock in an amount of 31.9 mass units per hour and having the characteristics presented in Table 2 are introduced into a post treat hydrotreating zone operated at a pressure of 9.06 MPa (1300 psig), an average catalyst temperature of 360° C. (680° F.) and a liquid hourly space velocity of 4.5 $hr.^{-1}$. The effluent from the post treat zone is cooled and partially condensed to produce a hydrogen-rich gaseous stream and a liquid hydrocarbonaceous stream which is flashed, stripped and fractionated.

TABLE 2

| Co-Feedstock Properties | |
|---|---|
| Boiling Range | 177° C. (350° F.)–360° C. (680° F.) |
| Specific Gravity | 0.872 |
| Sulfur, weight percent | 1.25 |
| Nitrogen, wppm | 435 |

A bottom liquid stream is removed from the hot, high pressure stripper and flashed in a hot flash drum operated at a pressure of 2.17 MPa (300 psig) and a temperature of 386° C. (728° F.) to produce a liquid stream in an amount of 68 mass units per hour which is subsequently introduced into a thermal cracking zone. A liquid hydrocarbonaceous stream containing hydrocarbons boiling above the diesel range produced in the hereinabove described fractionation zone in an amount of 7 mass units per hour is also introduced into the thermal cracking zone which is operated at a pressure of 2.17 MPa (300 psig) and a temperature of 496° C. (925° F.). The thermal cracker produced 3.8 mass units per day of naphtha and lighter, 31.4 mass units per day of diesel and 39.8 mass units per day of hydrotreated vacuum gas oil. Three mass units per day of thermal cracked naphtha and 31.4 mass units per day of thermal cracked diesel are passed to the post treat hydrotreating zone.

The resulting net products from the fractionation zones and their characteristics are presented in Table 3.

TABLE 3

| Products | | | |
|---|---|---|---|
| Product | Flow rate, mass units per hour | Sulfur, wppm | Cetane No. |
| Naphtha and lighter | 13.5 | <0.5 | |
| Diesel | 80.4 | <10 | 51 |
| Hydrotreated VGO | 39.8 | <200 | |

The foregoing description, drawing and illustrative embodiment clearly illustrate the advantages encompassed by the process of the present invention and the benefits to be afforded with the use thereof.

What is claimed is:

1. A hydrocracking process for the production of ultra low sulfur diesel from a first hydrocarbonaceous feedstock and a second hydrocarbonaceous feedstock boiling in a range lower than that of the first hydrocarbonaceous feedstock which process comprises the steps of:

(a) reacting the first hydrocarbonaceous feedstock and hydrogen in a hydrocracking zone containing hydrocracking catalyst to produce diesel boiling range hydrocarbons;

(b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream;

(c) passing the first gaseous hydrocarbonaceous stream comprising diesel boiling range hydrocarbons and the second hydrocarbonaceous feedstock to a desulfurization zone containing desulfurization catalyst and producing a desulfurization zone effluent stream;

(d) condensing at least a portion of the desulfurization zone effluent stream to produce a second hydrogen-rich gaseous stream and a second liquid hydrocarbonaceous stream comprising diesel boiling range hydrocarbons;

(e) passing the first liquid hydrocarbonaceous stream to a hot flash zone maintained at a pressure from about 445 kPa (50 psig) to about 2858 kPa (400 psig) and a temperature from about 232° C. (450° F.) to about 468° C. (875° F.) to produce a third liquid hydrocarbonaceous stream comprising unconverted hydrocarbons and diesel boiling range hydrocarbons;

(f) reacting the third liquid hydrocarbonaceous stream in a non-catalytic thermal cracking zone to produce an effluent stream containing additional diesel boiling range hydrocarbons;

(g) separating the effluent stream produced in step (f) to produce a fourth liquid hydrocarbonaceous stream comprising diesel boiling range hydrocarbons; and (h) recovering an ultra low sulfur diesel product stream.

2. The process of claim 1 wherein at least 25% by volume of the first hydrocarbonaceous feedstock boils between about 315° C. (600° F.) and about 538° C. (1000° F.).

3. The process of claim 1 wherein at least a majority of the second hydrocarbonaceous feedstock boils in the diesel boiling range.

4. The process of claim 1 wherein the hydrocracking zone is operated at conditions which include a temperature from about 232° C. (450° F.) to about 468° C. (875° F.) and a pressure from about 3.45 MPa (500 psig) to about 20.7 MPa (3000 psig).

5. The process of claim 1 wherein at least a majority of the diesel boiling range hydrocarbons boils in the range from about 154° C. (309° F.) to about 370° C. (698° F.).

6. The process of claim 1 wherein at least a majority of the second hydrocarbonaceous feedstock boils in the range from about 180° C. (356° F.) to about 370° C. (698° F.).

7. The process of claim 1 wherein at least a portion of the second hydrogen-rich gaseous stream is recycled to the hydrocracking zone in step (a).

8. The process of claim 1 wherein at least a portion of the second hydrogen-rich gaseous stream is recycled to the hot, high pressure stripping zone in step (b).

9. The process of claim 1 wherein the ultra low sulfur diesel product stream comprises less than about 50 wppm sulfur.

10. The process of claim 1 wherein the ultra low sulfur diesel product stream comprises less than about 10 wppm sulfur.

11. The process of claim 1 wherein the first hydrocarbonaceous feedstock is selected from the group consisting essentially of atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates.

12. The process of claim 1 wherein the conversion of the feedstock in the hydrocracking zone is preferably less than 80 volume percent, more preferably 60 volume percent and even more preferably less than 50 volume percent.

13. The process of claim 1 wherein the second hydrocarbonaceous feedstock is selected from the group consisting essentially of visbroken distillate, light cycle oil, straight run kerosene, straight run diesel, coker distillate and tar sand derived distillate.

14. The process of claim 1 wherein at least a portion of the fourth liquid hydrocarbonaceous stream is passed to the desulfurization zone containing desulfurization catalyst.

15. A hydrocracking process for the production of ultra low sulfur diesel from a first hydrocarbonaceous feedstock and a second hydrocarbonaceous feedstock boiling in a range lower than that of the first hydrocarbonaceous feedstock which process comprises the steps of (a) reacting the first hydrocarbonaceous feedstock and hydrogen in a hydrocracking zone containing hydrocracking catalyst to produce diesel boiling range hydrocarbons boiling in the range from about 154° C. (309° F.) to about 370° C. (680° F.);

(b) stripping a hydrocracking zone effluent in a hot, high pressure stripping zone maintained at essentially the same pressure as the hydrocracking zone and a temperature in the range of from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream;

(c) passing the first gaseous hydrocarbonaceous stream comprising diesel boiling range hydrocarbons and the second hydrocarbonaceous feedstock to a desulfurization zone containing desulfurization catalyst and producing a desulfurization zone effluent stream;

(d) condensing at least a portion of the desulfurization zone effluent stream to produce a second hydrogen-rich gaseous stream and a second liquid hydrocarbonaceous stream comprising diesel boiling range hydrocarbons;

(e) passing the first liquid hydrocarbonaceous stream to a hot flash zone maintained at a pressure from about 445 kPa (50 psig) to about 2858 kPa (400 psig) and a temperature from about 232° C. (450° F.) to about 468° C. (875° F.) to produce a third liquid hydrocarbonaceous stream comprising unconverted hydrocarbons and diesel boiling range hydrocarbons;

(f) reacting the third liquid hydrocarbonaceous stream in a non-catalytic thermal cracking zone to produce an effluent stream containing additional diesel boiling range hydrocarbons;

(g) separating the effluent stream produced in step (f) to produce a fourth liquid hydrocarbonaceous stream comprising diesel boiling range hydrocarbons;

(h) passing at least a portion of the fourth liquid hydrocarbonaceous stream to the desulfurization zone containing desulfurization catalyst; and (i) recovering an ultra low sulfur diesel product stream.

* * * * *